US006529787B2

(12) United States Patent
Weikel et al.

(10) Patent No.: US 6,529,787 B2
(45) Date of Patent: Mar. 4, 2003

(54) MULTIMEDIA COMPUTER SPEAKER SYSTEM WITH BRIDGE-COUPLED SUBWOOFER

(75) Inventors: Raymond K. Weikel, Beaverton, OR (US); Jeffrey S. Anderson, Camas, WA (US)

(73) Assignee: Labtec Corporation, Vancouver, WA (US)

( * ) Notice: Subject to any disclaimer, the term of this patent is extended or adjusted under 35 U.S.C. 154(b) by 0 days.

(21) Appl. No.: 09/440,153

(22) Filed: Nov. 15, 1999

(65) Prior Publication Data

US 2001/0018621 A1 Aug. 30, 2001

(51) Int. Cl.[7] ..... H06F 17/00
(52) U.S. Cl. ..... 700/94; 381/18; 381/28
(58) Field of Search ..... 700/94; 381/28, 381/300, 89, 332, 335, 18, 19

(56) References Cited

U.S. PATENT DOCUMENTS

| | | | | |
|---|---|---|---|---|
| 3,055,980 A | | 9/1962 | Percival | |
| 4,218,583 A | | 8/1980 | Poulo | |
| 5,243,656 A | * | 9/1993 | Tanida | 381/28 |
| 5,325,440 A | | 6/1994 | Fujisawa et al. | |
| 5,386,474 A | | 1/1995 | Grodinsky et al. | |
| 5,414,774 A | | 5/1995 | Yumoto | |
| 5,469,509 A | | 11/1995 | Navone et al. | |
| 6,118,876 A | * | 9/2000 | Ruzicka | 381/18 |

OTHER PUBLICATIONS

"Wiring Your Subs," http://tutorials.jlaudio.com/wiring/, 2 pages, Nov. 11, 1999.

"Wiring Your Subs/1DVC," http://tutorials.jlaudio.com/wiring/1dvc.html, 2 pages, Nov. 11, 1999.

"JL Audio: Tutorials: Bandpass enclosures," http://tutorials.jlaudio.com/bandpass/, 5 pages, Nov. 12, 1999.

"JL Audio: Tutorials: Bandpass enclosures," http://tutorials.jlaudio.com/bandpass/bptypes.html, 1 page, Nov. 12, 1999.

"What is the advantage of dual voice coils?," http://tutorials.jlaudio.com/dvc/dvcAdvantage.html, 1 page, Nov. 12, 1999.

"What is a dual voice coil speaker?," http://tutorials.jlaudio.com/dvc/whatisDVC.html, 1 page, Nov. 12, 1999.

"What does a voice coil do?, " http://tutorials.jlaudio.com/dvc/do.html, 1 page, Nov. 12, 1999.

"What is the point of a dual voice coil speaker if I have a mono–bridgeable amp?," http://tutorials.jlaudio.com/dvc/point.html, 2 page, Nov. 12, 1999.

* cited by examiner

*Primary Examiner*—Minsun Oh Harvey
(74) *Attorney, Agent, or Firm*—Ipsolon LLP

(57) ABSTRACT

A multimedia computer speaker system includes a pair of amplifiers that provide amplified right and left audio signals to a pair of wide-band speakers. The amplifiers are configured to provide the amplified right and left audio signals that are out of phase with each other. The amplified right and left audio signals are applied to opposite terminals of the two wide-band speakers. These reversed terminal couplings to the wide-band speakers of the phase-reversed signals provide phase-aligned right and left audio playback at the speakers. A subwoofer and a low pass filter are connected as a bridge-tied load to receive the amplified right and left audio signals. The phase of one amplified audio signal is in effect reversed by applying it to the negative terminal of the subwoofer. As a result, low frequency components of a phase reversed amplified audio signal are summed by the subwoofer with low frequency components of the other amplified audio signal to provide a low frequency audio playback.

28 Claims, 3 Drawing Sheets

MULTIMEDIA COMPUTER SPEAKER SYSTEM WITH BRIDGE-COUPLED SUBWOOFER

FIELD OF THE INVENTION

The present invention relates to multimedia computer speaker systems connectable to audio system control circuits (e.g., "sound cards") of multimedia computers and, in particular, to such a system that employs a "bridge-coupled" subwoofer to reduce the number of amplifiers in the system.

BACKGROUND AND SUMMARY OF THE INVENTION

Speaker systems with integral amplification electronics provide simple, compact audio reproducers for multimedia personal computers. These speaker systems, sometimes referred to as multimedia computer speaker systems, typically include pairs of wide-band speakers mounted in separate housings with amplification electronics incorporated into one or both housings. Because compactness is desirable, small, wide-band speakers (e.g., 3-inch diameter cone speaker drivers) are commonly used.

Many conventional multimedia computer systems include two-channel (stereo) multimedia computer speaker systems. Typically, a conventional two-channel computer audio system includes a two-channel audio system control circuit, which is commonly configured as a separate computer expansion board called a "sound card," and two wide-band audio transducers or speakers. A sub-woofer audio transducer or speaker is also included in many implementations. Conventional two-channel speaker systems are configured to provide at the two wide-band speakers distinct audio playback according to two distinct audio channels included in a multimedia computer work such as a game, music, etc. Playback at the subwoofer is typically a summed combination of the two distinct audio channels.

Typically, the speaker system includes a pair of amplifiers that provide. amplified right and left audio signals to corresponding ones of the wide-band. speakers. The subwoofer receives an audio signal that typically is generated from the right and left audio channels. In particular, the left and right audio channels are summed, and the sum is passed through a low pass filter to a sub-woofer amplifier. The subwoofer amplifier is coupled to the sub-woofer and drives it with a sum of the low-frequency components of the right and left audio channels.

Subwoofers are desirable because of the richer and deeper sounds that they provide in comparison to most two-piece multimedia computer speaker systems. However, a conventional subwoofer is a relatively expensive component of such a system due to the significant cost of the amplifier required for the subwoofer. It would be desired, therefore, to provide a three-piece multimedia computer speaker system that avoids the significant expense of conventional systems.

Accordingly, the present invention provides a multimedia computer speaker system with a pair of amplifiers that provide amplified right, and left audio signals to a pair of wide-band speakers. The amplifiers are configured to provide the amplified right and left audio signals that are out of phase with each other. The amplified right and left audio signals are applied to opposite terminals of the two wide-band speakers. For example, one signal is applied to the positive terminal of one wide-band speaker, and the other signal is applied to the negative terminal of the other wide-band speaker. These reversed terminal couplings to the wide-band speakers of the phase-reversed signals provide phase-aligned right and left audio playback at the wideband speakers.

A subwoofer is connected as a bridge-tied load to receive the amplified right and left audio signals. The phase of one amplified audio signal is in effect reversed by applying it to the negative terminal of the subwoofer. In one implementation, the right and left audio signals delivered to the subwoofer are electrically low-pass filtered. As a result, low frequency components of the phase reversed amplified audio signal are summed by the subwoofer with low frequency components of the other amplified audio signal to provide a low frequency audio playback. In another implementation, the subwoofer is contained within a ported enclosure that functions as an acoustic low pass filter. As a result, the phase-reversed audio signals are summed by the subwoofer to provide audio playback that is acoustically low-pass filtered.

The speaker system of the present invention utilizes only two amplifiers to drive three audio speakers: two wide-band speakers and a subwoofer. This speaker system employs fewer amplifiers than are used in conventional multimedia computer speaker systems. Such a reduction in electronic componentry can be significant for generally low-cost consumer articles such as multimedia computer speaker systems. The configuration of single ended amplifiers for the wideband speakers and the bridge coupled subwoofer delivers more power to the subwoofer than to the wideband speakers. The higher power demands of bass frequency audio playback are met with this configuration.

Additional objects and advantages of the present invention will be apparent from the detailed description of the preferred embodiment thereof, which proceeds with reference to the accompanying drawings.

DETAILED DESCRIPTION OF PREFERRED EMBODIMENTS

Figure 1:
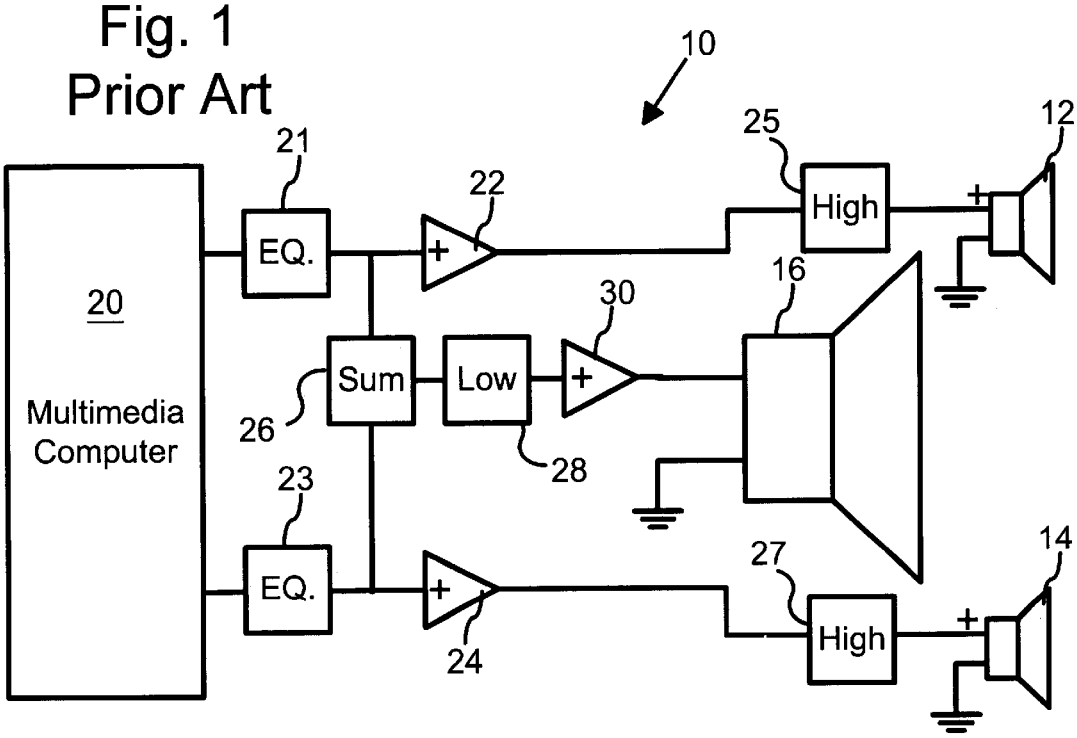
Fig. 1 Prior Art
FIG. 1 is a simplified block diagram of a prior art three-piece multimedia computer speaker system coupled to a computer such as a personal computer.

FIG. 1 is a simplified block diagram of a prior art three-piece multimedia computer speaker system 10, which includes a pair of amplified wide-band speakers 12 and 14 and a sub-woofer 16. Speakers 12 and 14 and subwoofer 16 are commonly contained within separate housings with speakers 12 and 14 sometimes referred to as satellite speakers. Speaker system 10 receives an audio signal from an audio output circuit (e.g., a "sound card," not shown) of a multimedia computer 20. Typically, the audio signal is a stereo audio signal that includes separate right and left audio channels that are applied to speakers 12 and 14, respectively. Speaker system 10 includes pair of equalizers 21 and 23 and a pair of amplifiers 22 and 24 that provide amplified right and left audio signals through high pass filters 25 and 27 to respective speakers 12 and 14.

Sub-woofer 16 receives an audio signal that typically is generated from the right and left audio channels. In particular, the right and left audio channels are passed to an adder or mixer 26 that sums the audio channels. The sum of the audio channels is passed through a low pass filter 28 to a sub-woofer amplifier 30 that is coupled to sub-woofer 16. As a result, subwoofert 16 is driven with a sum of the low-frequency components of the right and left audio channels. Speaker system 10 also commonly includes a volume control, such as a ground-connected potentiometer (not shown), that coupled between amplifiers 22, 24, and 30 and speakers 12, 14, and 16 to control the volume of audio playback provided by speaker system 10.

Figure 2:
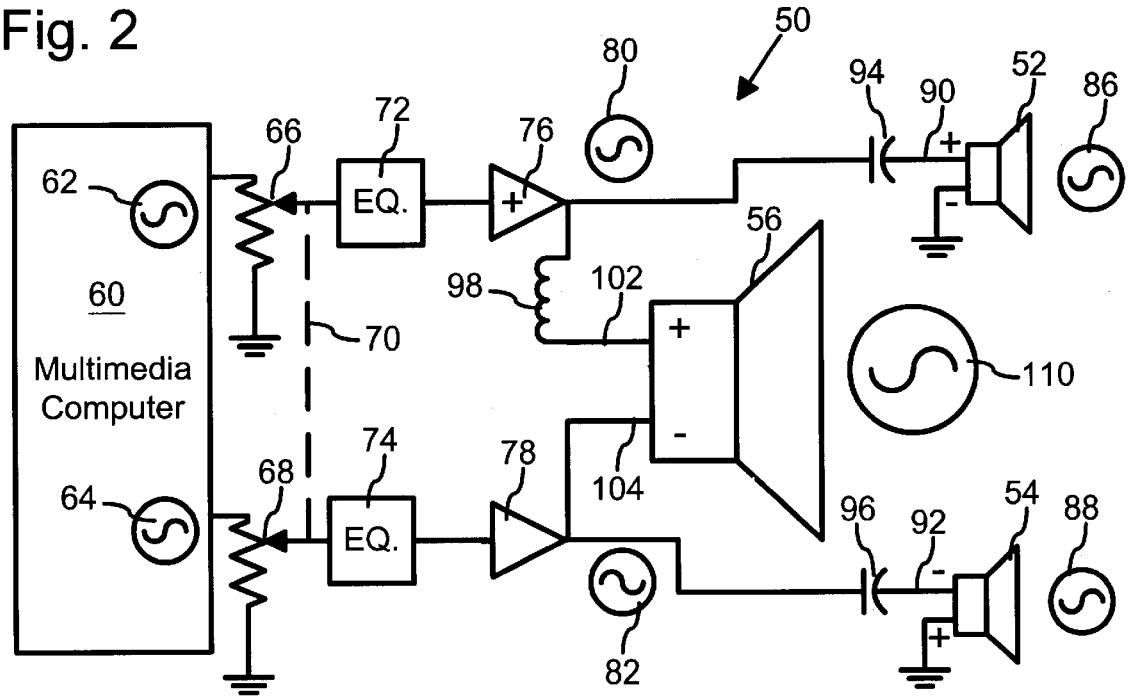
FIG. 2 is a simplified block diagram of a three-piece multimedia computer speaker system according to the present invention coupled to a computer such as a personal computer.

FIG. 2 is a simplified block diagram of a three-piece multimedia computer speaker system 50 according to the present invention. Speaker system 50 includes a pair of amplified wide-band speakers 52 and 54, and a sub-woofer 56. Speaker system 50 receives an audio signal from an audio output circuit (e.g., a "sound card," not shown) of a multimedia computer 60, such as a personal computer. The audio signal is a multi-channel (e.g., stereo) audio signal that includes separate right and left audio channels 62 and 64.

Speaker system 50 includes a pair of volume-control potentiometers 66 and 68, a pair of equalizers 72 and 74, and a pair of amplifiers 76 and 78 that, provide amplified right and left audio signals 80 and 82 to speakers 52 and 54, respectively. Potentiometers 66 and 68 are tied together (indicated schematically by dashed line 70) to provide user control of the volume of right and left audio channels 62 and 64. Amplifiers 76 and 78 are configured to provide amplified right and left audio signals 80 and 82 out of phase with each other. For example, one of amplifiers 76 and 78 is configured to provide non-inverting amplification, and the other of amplifiers 76 and 78 is configured to provide inverting amplification. For purposes of illustration, amplifiers 76 and 78 are shown as providing non-inverting and inverting amplification, respectively.

The combination of inverting and non-inverting amplification provided by amplifiers 76 and 78 results in amplified right and left audio signals 80 and 82 having between them a phase difference of 180 degrees. Amplified right and left audio signals 80 and 82 are applied to the terminals of speakers 52 and 54 in opposite phase. For example, amplified right audio signal 80 is applied to a positive terminal 90 of speaker-52, and amplified left audio signal 82 is, applied to a negative terminal 92 of speaker 54. A positive terminal of a speaker is characterized as the terminal that provides outward movement of the diaphragm when a positive voltage or current is applied. These reversed terminal couplings to speakers 52 and 54 of the phase-reversed signals 80 and 82 provide phase-aligned right and left audio playback 86 and 88 at speakers,52 and 54.

Amplified right and left audio signals 80 and 82 are delivered to speakers 52 and 54 through high pass filters 94 and 96, respectively, that block low frequency audio signal components. High pass filters 94 and 96 are illustrated as series-connected capacitors, but may be implemented in a variety of other ways.

Subwoofer 56 is connected as a bridge-tied load to receive amplified right and left audio signals 80 and 82 at positive terminal 102 and negative terminal 104, respectively. In one implementation, a low pass filter 98 is connected in series with subwoofer 56 and is illustrated as a series-connected inductor, but may be implemented in a variety of other circuit implementations.

The phase of amplified left audio signal 82 is in effect reversed by applying it to negative terminal 104. As a result, low frequency components of the phase reversed amplified left audio signal 82 are summed by subwoofer 56 with low frequency components of amplified right audio signal 80 to provide low frequency audio playback 110. Moreover, low frequency audio playback 110 is phase-aligned with right- and left-audio outputs 86 and 88 at speakers 52 and 54

The bridge mode coupling of subwoofer 56, in combination with the opposed phase of amplified right and left audio signals 80 and 82, allows amplifiers 76 and 78 to drive speakers 52 and 54, as well as subwoofer 56. As a result, speaker system 50 may be implemented with only one pair of amplifiers 76 and 78, rather than including one or more separate amplifiers that are dedicated to driving subwoofer 56. Such a reduction in electronic componentry can be significant for generally low-cost consumer articles such as multimedia computer speaker systems. The configuration of single ended amplifiers for wideband speakers 52 and 54 and bridge coupled subwoofer 56 delivers more power to sub-woofer 56 than to wideband speakers 52 and 54. The higher power demands of bass frequency audio playback are met with this configuration. More specifically, bridge-coup led amplifiers have a 6 dB voltage gain, or theoretically 4 times power the output of a single ended amplifier, assuming a fixed supply voltage and fix impedance load.

Figure 3:
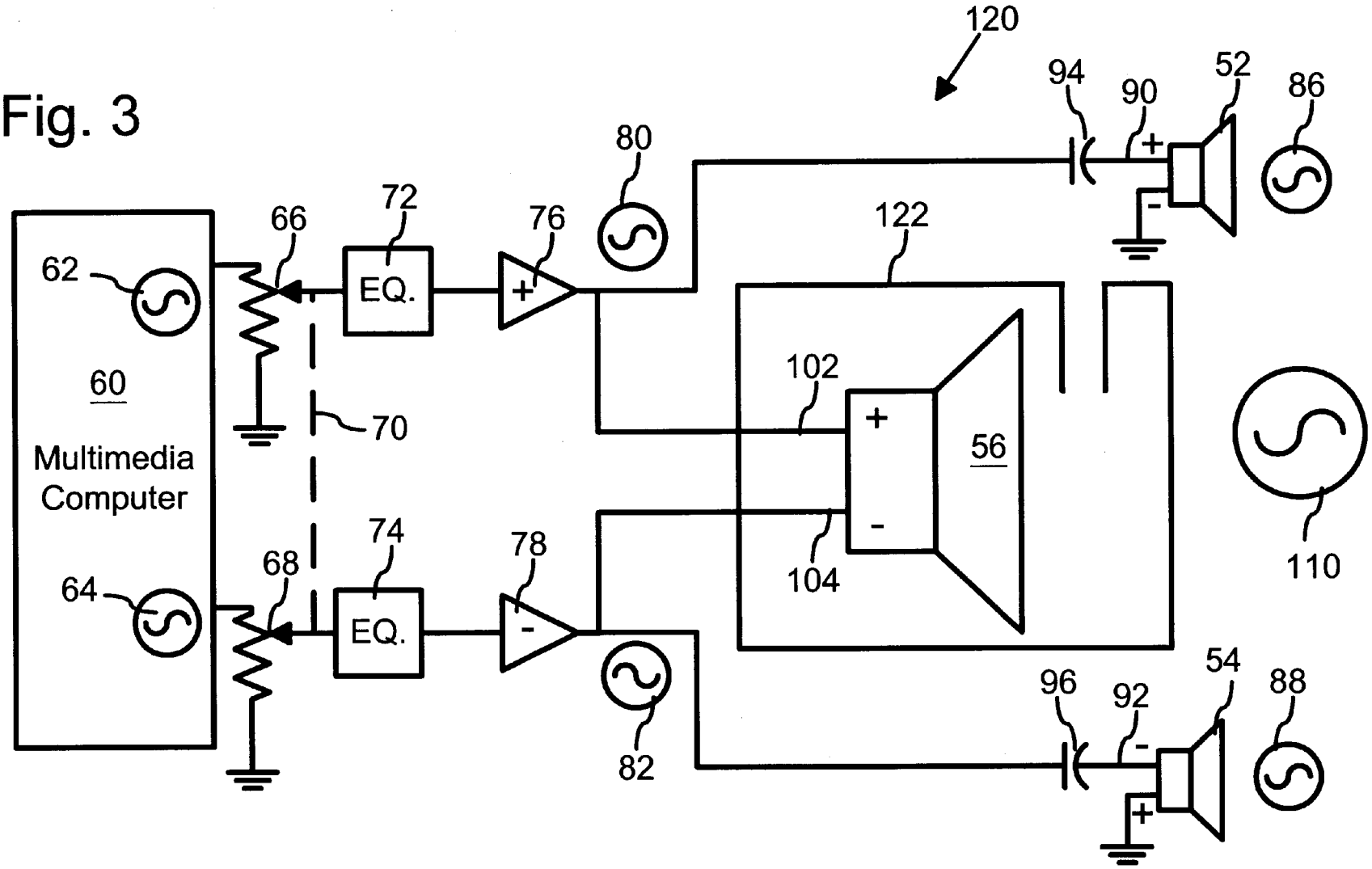
FIG. 3 is a simplified block diagram of an additional implementation of a three piece computer speaker system according to the present invention coupled to a computer such as a personal computer.

FIG. 3 is a simplified block diagram of another implementation of a three-piece multimedia computer speaker system 120 according to the present invention. Speaker system 120 is substantially the same as speaker system 50, with common components being identified by common reference numerals.

Speaker system 120 differs from speaker system 50 in that subwoofer 56 is acoustically low pass filtered in the former and electrically low pass filtered in the latter. Speaker system 120 includes a ported enclosure 122 that contains subwoofer 56 and functions to provide acoustic low pass filtering, as is known in the art. Accordingly, speaker system 120 does not include an electrical low pass filter 98 (e.g., an inductor, as shown in FIG. 2) that filters the electrical signal provided to subwoofer 56.

Figure 4:
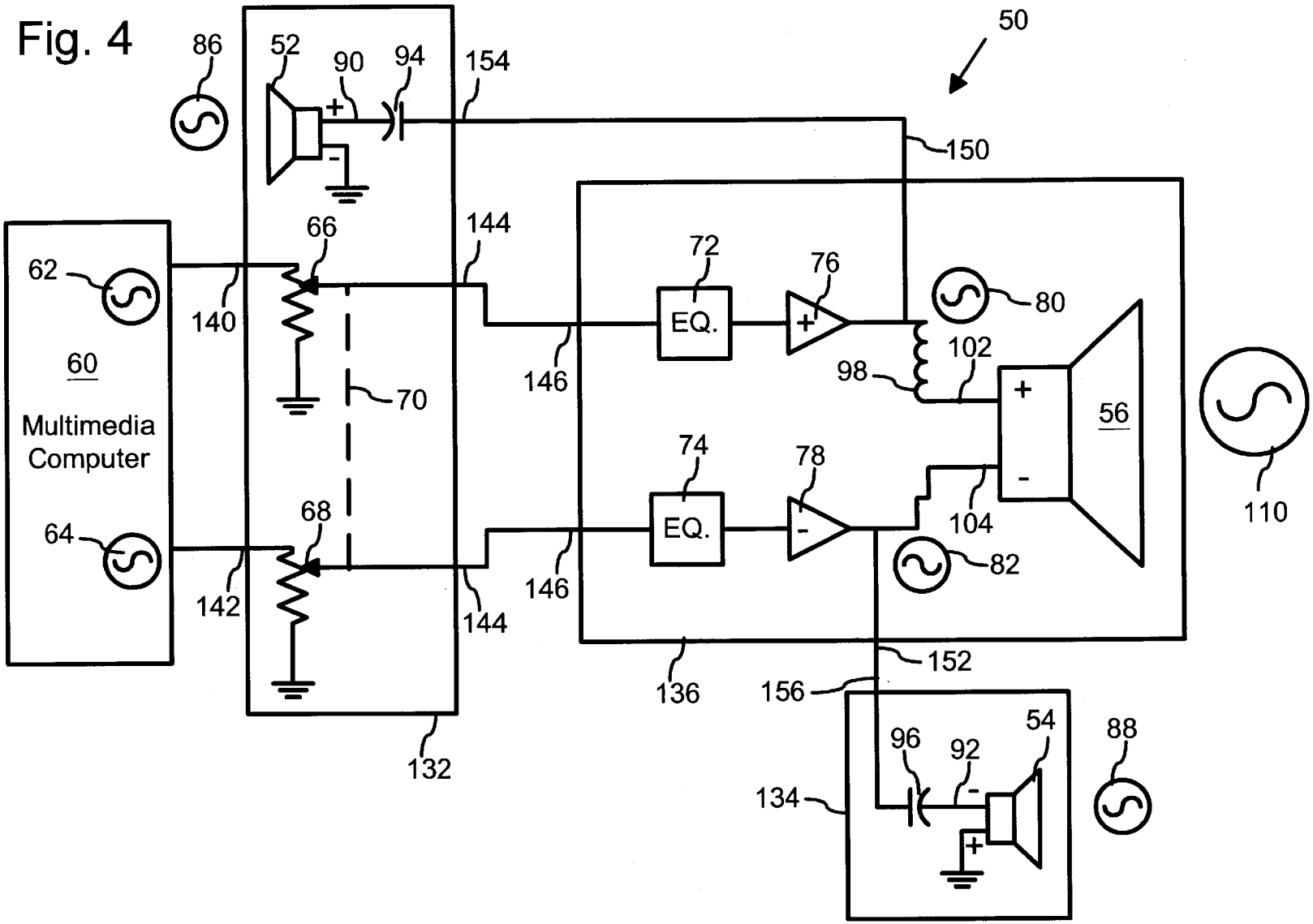
FIG. 4 is a schematic block diagram illustrating housings for the speakers of the speaker system of FIG. 2 and the circuit components contained within the housings.

FIG. 4 is a schematic block diagram illustrating housings 132, 134, and 136 for respective speakers 52, 54, and 56 of speaker system 50 and circuit components contained within the housings. Housings 132,134, and 136 are similarly applicable to speaker system 120, except that housing 136 for speaker system 120 includes one or more ports to provide acoustic low pass filtering.

Housing 132 includes inputs 140 and 142 to receive cables carrying respective right and left audio channels 62 and 64. Inputs 140 and 142 may be integrated into a single multi-channel coupling or plug. Housing 132 also contains potentiometers 66 and 68 and a user accessible knob (not shown) to control the volume of speaker system 50. An output 144 is connectable to a cable to carry the volume-controlled audio channels to an input 146 of subwoofer housing 136.

Housing 136 contains all the active circuitry of speaker system 50 (e.g., amplifiers 76 and 78). As a result, only housing 136 includes an input (not shown) for receiving DC power. Housing includes audio outputs 150 and 152 that are connectable to cables to carry amplified right and left audio signals 80 and 82 to inputs 154 and 156 on housings 132 and 134, respectively. Housings 132 and 134 are shown as including high pass filters 94 and 96. It will be appreciated, however, that high pass filters 94 and 96 could alternatively be included in housing 136.

The arrangement of components within housings 132, 134, and 136 provides a user-manipulated volume control at a wideband or satellite speaker in combination with a simplified cable arrangement. Controlling the volume of speaker system 50 with direct manipulation of right and left audio channels 62 and 64 allows all active circuit elements to be positioned in subwoofer housing 136, thereby eliminating a common requirement for power to be delivered to a satellite speaker.

Having described and illustrated the principles of our invention with reference to a preferred embodiment thereof, it will be apparent that the invention can be modified in arrangement and detail without departing from such principles. In view of the many possible embodiments to which the principles may be put, it should be recognized that the detailed embodiment is illustrative only and should not be taken as limiting the scope of our invention. Accordingly, we claim as our invention all such modifications as may come within the scope and spirit of the following claims and equivalents thereto.

What is claimed is:

1. In a multimedia computer speaker system having first and second wide-band speakers and a subwoofer for transducing a multi-channel audio signal from an audio output circuit of a multimedia computer, the system including first and second amplifiers that receive and amplify first and second channels of the audio signal and apply them to the first and second wide-band speakers, respectively, the improvement comprising:

phase-reversed amplification of the first and second channels of the audio signal to provide amplified first and second audio signals with reversed phase;

reversed terminal couplings of the first and second wide-band speakers to the amplified first and second audio signals; and a coupling of the subwoofer in series between the amplified first and second audio signals, whereby the subwoofer reproduces only low frequency components of the audio signal below a predetermined audio frequency.

2. The system of claim 1 in which the phase reversed amplification includes inverted amplification of the first channel and non-inverted amplification of the second channel.

3. The system of claim 1 in which the subwoofer is a bridge-tied load on the amplified first and second audio signals.

4. The system of claim 1 further comprising a low pass filter connected in series with one terminal of the subwoofer to pass selectively low frequency components of the amplified first and second audio signals.

5. The system of claim 4 in which the low pass filter is a series-connected inductor.

6. The system of claim 1 further comprising an acoustic low pass filter that contains the subwoofer such that it selectively provides low frequency playback of the amplified first and second audio signals.

7. The system of claim 6 further comprising no electrical low pass filtering of the amplified first and second audio signals coupled to the subwoofer.

8. The system of claim 1 further comprising a high pass filter connected in series with one terminal of each of the first and second wide-band speakers, each high pass filter to receive one of the amplified first and second audio signals.

9. The system of claim 8 in which each high pass filter is a series-connected capacitor.

10. The system of claim 1 in which the first and second wide-band speakers and a subwoofer are each contained in a separate housing, and the first and second amplifiers are the only active components of the system and are contained in the housing with the subwoofer.

11. The system of claim 10 further comprising a user-manipulated volume control in the housing for one of the wide-band speakers, the volume control controlling the multi-channel audio signal from the audio output circuit of a multimedia computer.

12. In a multimedia computer speaker system having first and second wide-band speakers and a subwoofer for transducing a multi-channel audio signal from an audio output circuit of a multimedia computer, the improvement comprising:

only one pair of amplifiers that receive and amplify first and second channels of the audio signal and apply them to the first and second wide-band speakers, respectively, and to the subwoofer, the one pair of amplifiers providing phase-reversed amplification of the first and second channels of the audio signal to provide amplified first and second audio signals with reversed phase;

reversed terminal couplings of the first and second wide-band speakers to the amplified first and second audio signals; and a coupling of the subwoofer in series between the amplified first and second audio signals, whereby the subwoofer reproduces only low frequency components of the audio signal below a predetermined audio frequency.

13. The system of claim 12 in which the phase reversed amplification includes inverted amplification of the first channel and non-inverted amplification of the second channel.

14. The system of claim 12 in which the subwoofer is a bridge-tied load on the amplified first and second audio signals.

15. The system of claim 12 in which the first and second wide-band speakers and a subwoofer are each contained in a separate housing, and the first and second amplifiers are contained in the housing with the subwoofer.

16. The system of claim 15 further comprising a user-manipulated volume control in the housing for one of the wide-band speakers, the volume control controlling the multi-channel audio signal from the audio output circuit of a multimedia computer.

17. The system of claim 12 further comprising a low pass filter connected in series with one terminal of the subwoofer to pass selectively low frequency components of the amplified first and second channels of the audio signal.

18. The system of claim 12 further comprising an acoustic low pass filter that contains the subwoofer such that it selectively provides low frequency playback of the amplified first and second channels of the audio signal.

19. In a multimedia computer speaker system having first and second wide-band speakers and a subwoofer for transducing a multi-channel audio signal from an audio output circuit of a multimedia computer, the system including first and second amplifiers that receive and amplify first and second channels of the audio signal and apply them to the first and second wide-band speakers, respectively, a method comprising:

providing phase-reversed amplification of the first and second channels of the audio signal to provide amplified first and second audio signals with reversed phase;

providing reversed terminal couplings of the first and second wide-band speakers to the amplified first and second audio signals; and providing a coupling of the subwoofer in series between the amplified first and second audio signals, whereby the subwoofer reproduces only low frequency components of the audio signal below a predetermined audio frequency.

20. The method of claim 19 in which the phase reversed amplification includes inverted amplification of the first channel and non-inverted amplification of the second channel.

21. The method of claim 19 in which providing couplings between the subwoofer and the amplified first and second audio signals includes providing the subwoofer as a bridge-tied load on the amplified first and second audio signals.

22. The method of claim 19 further comprising providing low pass filtering in series with one terminal of the subwoofer to pass selectively low frequency components of the amplified first and second audio signals.

23. The method of claim 19 further comprising providing acoustic low pass filtering of the subwoofer so it selectively provides low frequency playback of the amplified first and second audio signals.

24. The method of claim 19 further comprising providing high pass filter in series with one terminal of each of the first and second wide-band speakers, each high pass filter to receive one of the amplified first and second audio signals.

25. In a multimedia computer speaker system having first and second wide-band speakers and a subwoofer for transducing a multi-channel audio signal from an audio output circuit of a multimedia computer, the subwoofer being contained within a subwoofer housing, the improvement comprising:

one pair of amplifiers that are contained within the subwoofer housing and receive and amplify first and second channels of the audio signal and apply them to the first and second wide-band speakers, respectively, and to the subwoofer, the pair of amplifiers providing phase-reversed amplification of the first and second channels of the audio signal to provide amplified first and second audio signals with reversed phase;

reversed terminal couplings of the first and second wide-band speakers to the amplified first and second audio signals; and a coupling of the subwoofer in series between and the amplified first and second audio signals, whereby the subwoofer reproduces only low frequency components of the audio signal below a predetermined audio frequency.

26. The system of claim 25 in which the phase reversed amplification includes inverted amplification of the first channel and non-inverted amplification of the second channel.

27. The system of claim 25 in which the subwoofer is a bridge-tied load on the amplified first and second audio signals.

28. The system of claim 25 in which the first and second wide-band speakers are contained in one or more housings separate from the subwoofer housing, the system further comprising a user-manipulated volume control in one of the one or more housings for the wide-band speakers, the volume control controlling the multi-channel audio signal from the audio output circuit of a multimedia computer.

* * * * *